US005500195A

United States Patent [19]

Garcia-Mallol

[11] Patent Number: 5,500,195

[45] Date of Patent: Mar. 19, 1996

[54] METHOD FOR REDUCING GASEOUS EMISSION OF HALOGEN COMPOUNDS IN A FLUIDIZED BED REACTOR

[75] Inventor: Juan A. Garcia-Mallol, Morristown, N.J.

[73] Assignee: Foster Wheeler Energy Corporation, Clinton, N.J.

[21] Appl. No.: 312,024

[22] Filed: Sep. 26, 1994

Related U.S. Application Data

[63] Continuation of Ser. No. 976,025, Nov. 13, 1992, abandoned.

[51] Int. Cl.[6] ..... B01D 53/68; B01D 53/81

[52] U.S. Cl. ..... 423/240 R; 423/240 S; 423/DIG. 5; 423/DIG. 6; 423/DIG. 16; 55/341.1; 95/8; 95/13; 95/17; 95/108; 95/131; 95/137; 95/278; 95/282; 95/285

[58] Field of Search ..... 423/240 S, 241, 423/240 R, 244.08, DIG. 5, DIG. 6, DIG. 16; 96/111, 112, 109; 95/131, 132, 137, 108, 8, 17, 13, 278, 282, 285, 11; 55/341.1

[56] References Cited

U.S. PATENT DOCUMENTS

| | | | |
|---|---|---|---|
| 4,042,667 | 8/1977 | Ishiwata et al. | 423/240 |
| 4,076,796 | 2/1978 | Reh et al. | 423/659 |
| 4,185,080 | 1/1980 | Rechmeier | 423/242 |
| 4,548,797 | 10/1985 | Sauer et al. | 423/240 |
| 4,931,264 | 6/1990 | Rochelle et al. | 423/242 |
| 4,981,111 | 1/1991 | Bennett et al. | 110/347 |

FOREIGN PATENT DOCUMENTS

| | | | |
|---|---|---|---|
| 220905 | 4/1985 | Germany | 423/240 |
| 49-39567 | 4/1974 | Japan | 95/278 |
| 61-33216 | 2/1986 | Japan | 95/108 |
| 2298316 | 12/1990 | Japan | 95/8 |
| 584882 | 12/1977 | U.S.S.R. | 95/13 |

OTHER PUBLICATIONS

"Fluidized Bed Processing" by L. Reh; Chem. Eng. Prog. (vol. 67 No. 2) Feb. 71 pp. 58–63.

"Chemical Engineers' Handbook" by R. H. Perry et al; 5th ed. McGraw–Hill Book Co.; 1973, pp. 22–118 and 22–120.

Perry, John H., *Chemical Engineers' Handbook*, McGraw–Hill Book Co. (3rd Ed.), 1029–1034 (1950).

*Primary Examiner*—Gary P. Straub
*Assistant Examiner*—Timothy C. Vanoy
*Attorney, Agent, or Firm*—Marvin A. Naigur

[57] ABSTRACT

A method for reducing gaseous emission of halogen compounds in a fluidized bed reactor in which the fine particles entrained in flue gases are used to form a temporary layer of particles on the baghouse filter to absorb halogen gases.

21 Claims, 1 Drawing Sheet

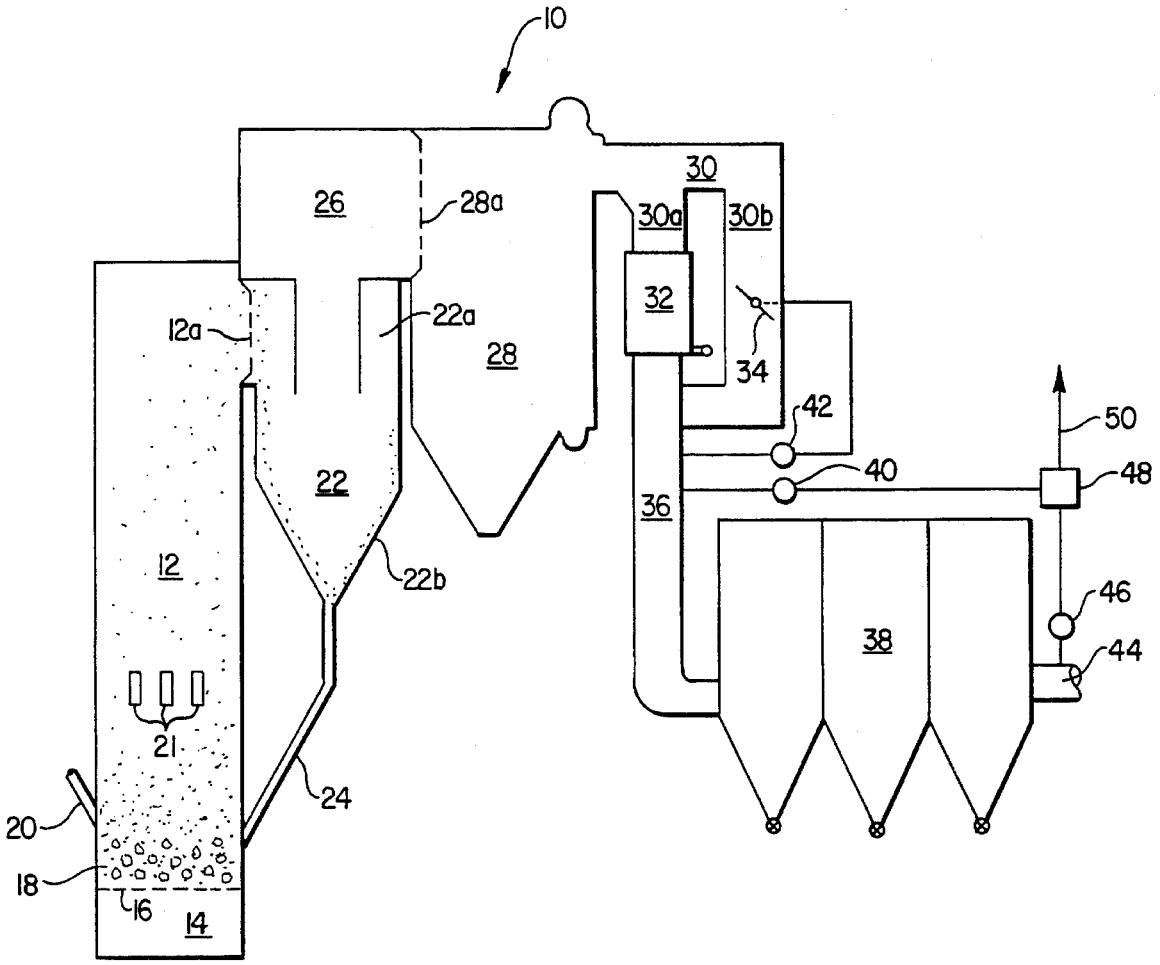
10
26
28a
30
30a
30b
32
34
12a
22a
28
42
50
40
48
22
36
12
22b
46
38
44
21
24
20
18
16
14

METHOD FOR REDUCING GASEOUS EMISSION OF HALOGEN COMPOUNDS IN A FLUIDIZED BED REACTOR

This is a continuation of application Ser. No. 07/976,025, filed on Nov. 13, 1992, now abandoned.

BACKGROUND OF THE INVENTION

This invention relates to fluidized bed reactors, and more particularly, to a method to reduce the emission of halogen compounds in gaseous products resulting from the combustion of halogen containing fuels in fluidized bed reactors.

Substantial efforts have been made to reduce emission of halogen compounds An gaseous products resulting from the combustion of halogen containing fuels, such as certain coals, industrial and municipal wastes, to comply with environmental regulations. In general, there are three prior art methods to reduce halogen emissions in flue gases: wet scrubbing, spray drying and dry-solids contact. In both the wet scrubbing and spray drying processes, a reaction vessel provides a region in which an interaction between a mixture of water and an alkaline sorbent-material, such as lime, and the flue gases can take place. The mixture of water and sorbent material forms an alkaline solution which is highly conducive to the absorption of halogen compounds, such as hydrogen halide. Unfortunately, both the wet scrubbing and spray drying processes suffer from major problems with scaling and corrosion resulting from the presence of an aqueous solution phase. The dry-solids contact process, while avoiding the problems associated with the aqueous solution phase, suffers from a relatively low halogen removal efficiency due to relatively slow solid-gas reaction kinetics.

The dry-solids contact process typically involves the injection of a dry, alkaline sorbent-material, such as limestone, into the combustion vessel of a fluidized bed reactor. Unfortunately, only the most reactive halogen, fluorine, is retained in the sorbent material while only a small portion of the most abundant halogen, chlorine is retained due to the elevated temperatures disposed within the combustion vessel.

In other known dry-solids contact processes, a dry, alkaline, sorbent material, such as lime, is introduced into the flue gases upstream from a baghouse and the sorbent material is distributed over the input side of a baghouse filter. The filter thus provides a region in which interaction between the sorbent material and the flue gases can take place.

This latter process of dry scrubbing is generally considered too expensive for use in many industrial fluidized bed reactors because it incurs a significant cost disadvantage by using lime instead of limestone since the cost of lime is as much a ten times the cost of the limestone.

Accordingly, there remains a need in the art for a dry-solids contact process to remove halogen compounds from flue gases without incurring the additional cost of using lime.

SUMMARY OF THE INVENTION

It is therefore an object of the present invention to provide a method which reduces the emission of halogen compounds in gaseous products resulting from the combustion of halogen containing fuels.

It is a further object of the present invention to provide a method of the above type which is economical to operate.

It is a further object of the present invention to provide a method of the above type which provides the required residency time and temperature for the gaseous products to effect proper scrubbing of the halogen compounds.

Toward the fulfillment of these and other objects, the temperature of flue gases containing entrained relatively-fine particles from a fluidized bed reactor is regulated prior to the flue gases entering a baghouse. In this manner, the entrained fine particles, containing significant amounts of unsulfated limestone, form a temporary boundary layer on the baghouse filter for the absorption of halogen compounds.

BRIEF DESCRIPTION OF THE DRAWINGS

The above brief description, as well as further objects, features and advantages of the present invention will be more fully appreciated by reference to the following detailed description of the presently preferred but nonetheless illustrative embodiment in accordance with the present invention when taken in conjunction with the drawing which illustrates a schematic view of the system of the present invention.

DESCRIPTION OF THE PREFERRED EMBODIMENT

The method of the present invention will be described in connection with a fluidized bed reactor forming a portion of a natural water circulation steam generator, shown in general by the reference numeral 10 in the drawing.

The steam generator 10 includes a fluidized bed reactor 12 having four walls. It is understood that each wall is formed by a plurality of vertically-disposed tubes interconnected by vertically elongated bars or fins to form a substantially rectangular, contiguous and air-tight structure. Since this type of structure is conventional, it is not shown in the drawings nor will it be described in any further detail.

A plenum chamber 14 is disposed at the lower portion of the reactor 12 into which pressurized air from a suitable source (not shown) is introduced by conventional means, such as a forced-draft blower, or the like.

A perforated air distribution plate 16 is suitably supported at the lower end of the combustion chamber of the reactor 12, and above the plenum chamber 14. The air introduced through the plenum chamber 14 passes in an upwardly direction through the air distribution plate 16 and may be preheated by air preheaters (not shown) and appropriately regulated by air control dampers as needed. The air distribution plate 16 is adapted to support a bed 18 of particulate material consisting in general, of crushed coal, as well as limestone, and/or dolomite, for absorbing a portion of the sulfur oxides (SOx) formed during the combustion of the coal.

A fuel distributor 20 extends through the front wall of the reactor 12 for introducing particulate fuel into the bed 18, it being understood that other distributors can be associated with the walls of the reactor 12 for distributing particulate sorbent material and/or additional particulate fuel material into the bed 18, as needed.

A multiplicity of air ports 21 are provided through a side wall of the reactor 12 at a predetermined elevation from the bed 18 to introduce secondary air into the reactor 12 for reasons to be described. It is understood that additional air ports at one or more elevation can be provided through the sidewalls of the reactor 12 as needed.

An opening 12*a* formed in the upper portion of the rear wall of the reactor 12 by bending back some of the tubes (not shown) forming the latter wall and connecting the reactor 12 with a cyclone separator 22 of conventional construction. Gases thus enter the separator 22 from the reactor 12, and swirl around in an annular chamber 22*a* defined in the separator to separate a portion of the entrained relatively-fine particles therefrom by centrifugal forces, before the gases leave the separator. 22. The separator 22 includes a hopper portion 22*b* into which the separated fine particles fall before being passed back into the reactor 12 by a recycle conduit 24.

A duct 26 is disposed above, and connected to, the cyclone separator 22 and operates to pass the separated flue gases which contain entrained relatively-fine particulate material that was not separated out in the separator 22 to a heat recovery enclosure 28 that is formed adjacent the duct 26. An opening 28*a* formed in the upper wall portion of the heat recovery enclosure 28 to receive the relatively-clean hot flue gases from the duct 26. The heat recovery enclosure 28 is of conventional construction and operates to transfer heat from the hot flue gases to a cooling medium such as water which is in fluid flow relationship with flow conduits, and the like, of the steam generator 10.

A gas flow duct 30 is formed adjacent the heat recovery enclosure 28 for receiving the relatively-clean flue gases from the enclosure 28 and divides into two branch ducts 30*a* and 30*b*. Art upper economizer 32 is disposed in branch duct 30*a* and operates to transfer heat from the flue gases to water flowing through conventional water flow circuitry of the economizer. A damper 34 is disposed in branch duct 30*b* and operates to control the flow of flue gases through branch duct 30*a* for purposes that will be described later.

A gas flow duct 36 is provided below the branch ducts 30*a* and 30*b* for connecting a baghouse 38 in gas flow communication with the ducts 30*a* and 30*b*. A halogen monitoring device 40 and a temperature monitoring device 42 are connected to the duct 36 and monitor the halogen content and temperature, respectively, of the flue gases entering the baghouse 38. The temperature monitoring device 42 is electrically connected to the damper 34 and sends the damper 34 control signals to regulate the flow of the flue gases through the duct 30*b* and, consequently, the temperature of the flue gases to the baghouse 38.

The baghouse 38 is of a conventional design and contains, for example, fabric filters in the path of the gases as they pass through the baghouse. An outlet duct 44 extends from the baghouse 38 for discharging gases from the baghouse to an external stack, or the like. A second halogen monitoring device 46 is connected to the duct 44 for monitoring the halogen content of the flue gases exiting the baghouse 38. The halogen monitoring devices 40 and 46 are electrically connected to a control device 48 which operates to produce control signals on a control line shown in part by the reference numeral 50. The control line 50 is used to control the baghouse cycle rate and/or the limestone feed rate as necessary to control the emission of halogen compounds.

In operation of the steam generator 10, a quantity of start-up coal with limestone for absorbing a portion of the sulfur oxides generated as a result of the combustion of the coal, is introduced to, and spread over the upper surface of, the particulate material in the bed 18. Air is introduced into the plenum chamber 14 and passes through the coal and limestone within the bed 18 and the start-up coal and limestone is ignited by burners (not shown) positioned within the bed. As the combustion of the coal progresses, additional air is introduced into the plenum chamber 14 at a relatively high pressure and velocity. Alternately, the bed 18 can be warmed up by a burner located in the plenum chamber 14.

The primary air introduced through the plenum chamber 14 comprises a fraction of the total air required for complete combustion of the coal so that the combustion in the lower section of the reactor 12 is incomplete. The latter section thus operates under reducing conditions and the remaining air required for complete combustion of the coal is supplied by the air ports 21. When operating at maximum capacity, the range of air supplied through the plenum 14 can be from 40% to 90% of that required for complete combustion, with this amount varying according to the desired bed temperature, while the remaining air (60% to 10%) is supplied through the ports 21 to complete the combustion.

The high-pressure, high-velocity, combustion-supporting air introduced by the air distribution plate 16 from the plenum chamber 14 causes the particles of the relative-fine particulate material, including particles of coal ash and limestone, to become entrained within, and to thus be pneumatically transported by, hot flue gases consisting of air and the gaseous products of combustion. This mixture of entrained particles and flue gases rises upwardly within the reactor 12 to form a gas column containing the entrained particles.

The relatively coarse particles accumulate in the lower portion of the reactor 12 along with a portion of the relatively fine particles while the remaining portion of the relatively fine particles pass upwardly through the gas column. The mixture of the hot flue gases and a portion of the relatively fine particles travel the length of the gas column and exit from the reactor 12 through the opening 12*a*. A portion of the relatively fine particles are separated from the hot flue gases within the separator 22, and are recycled back to the fluidized bed 18 through the recycle conduit 24, while the remaining portion of the relatively fine particles remain entrained in the flue gases. Particulate fuel material is supplied, in addition to the recycled portion of fine particles, at a sufficient rate to saturate the gas column formed above the bed 18 in the reactor 12, i.e., maximum entrainment of the relatively fine particles by the flue gases is obtained.

The mixture of hot flue gases and fine particles pass through the heat recovery enclosure 28 in a heat exchange "opening 28*a* into" after "the" and add "and" after "28" so that the last line on page 11 reads as follows: "through the opening 28*a* into heat recovery enclosure 28 and in a heat exchange" relation with water passing through conventional water flow circuitry (not shown), to transfer heat from the mixture prior to the mixture entering the duct 30 including the branch ducts 30*a* and 30*b*. The damper 34 receives control signals from the temperature monitoring device 42 and operates to control the temperature of the mixture entering the baghouse 38 by regulating the flow of the mixture through the duct 30*b*, and therefore through the duct 30*a* to regulate the transfer of heat from the mixture flowing through the latter duct to the economizer 32. Thus, the mixture enters the baghouse 38 at a controlled temperature range which preferably is between 525° F. and 615° F.

A portion of the fine particles in the mixture entering the baghouse 38 are particles of limestone which are both unsulfated and have undergone chemical conversion to calcined limestone as a result of the high temperature in the reactor 12. According to a feature of this invention, the mixture of flue gases and entrained fine particles enter the baghouse 38 and the particles accumulate on the baghouse filter so as to form a temporary layer of sufficient thickness for the flue gases in the mixture to take between 0.1 and 1.0 seconds to traverse the layer. The above-mentioned controlled temperature range is conducive to the absorption of halogen compounds in the flue gases by the calcined limestone particles which accumulated on the filter, and the baghouse cycle rate and/or the limestone feed rate are regulated by the control device 48 to maximize the absorption of halogen gases as indicated by the halogen monitoring devices 40 and 46 whose outputs can be used to control the baghouse cycle rate and/or the limestone feed rate, as described above.

It is thus seen that the method of the present invention utilizes the limestone in the entrained fine particles contained in the flue gases for the absorption of halogen compounds resulting from the combustion of fuels containing halogen. The use of the limestone particles in this manner results in significant cost savings in that it avoids the recurring costs associated with the procurement of halogen sorbing compounds, such as lime, in addition to the non-recurring cost associated with the equipment required for the injection of halogen sorbing compounds.

Although not specifically illustrated in the drawing, it is understood that additional necessary equipment and structural components will be provided, and that these and all of the components described above are arranged and supported in any appropriate fashion to form a complete and operative system.

It is also understood that variations may be made in the method of the present invention without departing from the scope of the invention. For example, the fluidized bed reactor need not be of the "circulating" type but could be any other type of fluidized bed in which halogen containing fuels undergo combustion in the presence of sulfur-oxide sorbing-materials, such as limestone. Further, the absorption of halogen by the limestone can be augmented by injection of other alkaline sorbent material, such as lime, limestone or other halogen sorbing-materials.

Of course, other variations in the foregoing can be made by those skilled in the art, and in certain instances some features of the invention will be employed without a corresponding use of other features. Accordingly, it is appropriate that the appended claims be construed broadly and in a manner consistent with the scope of the invention.

What is claimed is:

1. A method for reducing gaseous emission of halogen compounds from a fluidized bed reactor comprising the steps of:

forming a bed of solid particles, including a fuel material and a sorbent material, in said reactor, introducing air to said bed to fluidized said particles and to promote the combustion of said fuel particles which generates flue gases, containing said halogen compounds, recovering said flue gases from said reactor, said flue gases containing entrained particles comprising particles of unsulfated limestone and calcined limestone, separating a portion of said entrained particles from said flue gases, passing said flue gases with the remaining portion of said entrained particles to a baghouse, establishing a temporary layer of said remaining portion of entrained particles on the baghouse filter in said baghouse, monitoring the halogen content of said flue gases leaving the baghouse, and controlling the temperature of said flue gases and entrained particles entering the baghouse to a temperature from about 525° to about 615° F. and controlling the cycle rate of said baghouse in response to said halogen content so that essentially all of halogen compounds in said flue gases are absorbed by said layer of entrained particles.

2. The method of claim 1 wherein the rate of introduction of said sorbent material into said reactor is controlled in response to the halogen content of said flue gases leaving said baghouse.

3. The method of claim 2 wherein the rate of introduction of said sorbent is controlled in response to the halogen content of said flue gases entering said baghouse.

4. The method of claim 1 wherein said remaining portion of said entrained particles includes said fuel material and said sorbent material and wherein said sorbent material absorbs said halogen compounds.

5. The method of claim 1 further comprising the step of recycling said separated portion of said entrained particles to said reactor.

6. The method of claim 1 wherein said temperature control step comprises the step of selectively extracting heat from at least a portion of said gases and entrained particles.

7. The method of claim 6 wherein said temperature control step further comprises the step of monitoring the temperature of said flue gases entering and/or exiting the baghouse and controlling said temperature of said flue gas in response to said temperature.

8. The method of claim 6 wherein said step of extracting comprises the steps of dividing said flue gases into two steams, said heat being extracted from one of said steams, and regulating the relative flows of said streams.

9. The method of claim 1 wherein said sorbent material is a dry sorbent material.

10. The method of claim 1 wherein said sorbent material is limestone and further comprising the step of controlling the temperature in said reactor so that said limestone is calcinated whereby the calcinated limestone particles in said layer absorb said halogen compounds.

11. The method of claim 1 wherein said flue gases take from 0.1 to about 1.0 seconds to traverse said layer.

12. A method for reducing gaseous emission of halogen compounds from a fluidized bed reactor comprising the steps of:

forming a bed of solid particles, including a fuel material, in said reactor, introducing particles of limestone to said bed;

introducing air to said bed to fluidize said particles and to promote the combustion of said fuel particles which generates flue gases containing said halogen compounds and entrained particles of calcined limestone;

passing said flue gases with at least a portion of said calcined limestone to a baghouse, controlling the temperature of said flue gases and calcined limestone entering the baghouse to a temperature conducive for said calcined limestone to adsorb said halogen;

monitoring the halogen content of said flue gases entering and leaving the baghouse, and controlling the content of said calcined limestone in said flue gases in response to said monitored halogen content so that a temporary layer of said calcined limestone is established on the baghouse filter in said baghouse sufficient to absorb essentially all of said halogen compounds.

13. The method of claim 12 wherein said latter step of controlling comprises the step of controlling the amount of limestone particles introduced into said reactor.

14. The method of claim 12 wherein said latter step of controlling comprises the step of controlling the baghouse cycle rate.

15. The method of claim 12 wherein said latter step of controlling comprises the step of separating a portion of said calcined limestone particles from said flue gases before said step of passing.

16. The method of claim 15 further comprising the step of recycling said separated particles to said reactor.

17. The method of claim 12 wherein said temperature of said flue gases and calcined limestone is controlled to a temperature from about 525° F. to about 615° F.

18. The method of claim 12 wherein said temporary layer of calcined limestone is such that said flue gases take from 0.1 to about 1.0 seconds to traverse said layer.

19. The method of claim 12 wherein said temperature control step comprises the step of selectively extracting heat from at least a portion of said gases and entrained particles.

20. The method of claim 19 wherein said temperature control step further comprises the step of monitoring the temperature of said flue gases entering and/or exiting the baghouse and controlling said temperature of said flue gas in response to said temperature.

21. The method of claim 17 wherein said step of extracting comprises the steps of dividing said flue gases into two streams, said heat being extracted from one of said streams, and regulating the relative flows of said streams.

* * * * *

UNITED STATES PATENT AND TRADEMARK OFFICE

CERTIFICATE OF CORRECTION

PATENT NO. : 5,500,195

DATED : March 19, 1996

INVENTOR(S) : Juan A. Garcia-Mallol

It is certified that error appears in the above-indentified patent and that said Letters Patent is hereby corrected as shown below:

Col. 1, line 15, after compounds, delete "An" and insert --in--.

Col. 3, line 28, after "and 30b." delete "Art" and insert --An--.
Col. 4, line 45, after "through the" insert --opening 28a into--.
Col. 4, line 45, after "enclosure 28" insert --and--.
Col. 4, delete complete line 46 that begins with "opening 28a".
Col. 4, delete complete line 47 that begins with "that the last line".
Col. 4, delete complete line 48 that begins with "opening 28a into heat".
Col. 4, line 49, delete the first word "exchange".

Signed and Sealed this

Eighth Day of July, 1997

Bruce Lehman

*Attest:*

BRUCE LEHMAN

*Attesting Officer*

*Commissioner of Patents and Trademarks*